United States Patent [19]

Bianchi et al.

[11] Patent Number: 4,544,464

[45] Date of Patent: Oct. 1, 1985

[54] GROUND ANODE PREPACKED WITH BACKFILL IN A FLEXIBLE STRUCTURE FOR CATHODE PROTECTION WITH IMPRESSED CURRENTS

[75] Inventors: Giuseppe Bianchi; Gianluigi Mussinelli; Giuseppe Faita, all of Lugano, Switzerland

[73] Assignee: Oronzio de Nora S.A., Lugano, Switzerland

[21] Appl. No.: 602,819

[22] Filed: Apr. 23, 1984

[30] Foreign Application Priority Data

Dec. 23, 1983 [IT] Italy ..... 24356 A/83

[51] Int. Cl.[4] ..... C23F 13/00

[52] U.S. Cl. ..... 204/147; 204/196

[58] Field of Search ..... 204/147, 148, 196, 197

[56] References Cited

U.S. PATENT DOCUMENTS

| | | | |
|---|---|---|---|
| 2,053,214 | 9/1936 | Brown | 204/196 |
| 3,022,242 | 2/1962 | Anderson | 204/196 |
| 3,409,530 | 11/1968 | Locke et al. | 204/196 |
| 3,497,443 | 2/1970 | Von Burgsdorff | 204/196 |
| 3,527,685 | 9/1970 | Anderson | 204/196 |
| 3,616,418 | 10/1971 | Anderson et al. | 204/196 |
| 3,689,395 | 9/1972 | Blount et al. | 204/197 |
| 3,725,669 | 4/1973 | Tatum | 204/196 |
| 4,279,729 | 7/1981 | Bushman et al. | 204/196 |
| 4,292,149 | 9/1981 | Warne | 204/196 |
| 4,400,259 | 8/1983 | Shutt | 204/196 |
| 4,452,683 | 6/1984 | De Nora et al. | 204/196 |

FOREIGN PATENT DOCUMENTS

| | | | |
|---|---|---|---|
| 202900 | 10/1983 | Fed. Rep. of Germany | 204/196 |
| 47-43730 | 11/1972 | Japan | 204/196 |

*Primary Examiner*—T. Tung

*Attorney, Agent, or Firm*—Bucknam and Archer

[57] ABSTRACT

Flexible ground anode prepacked with backfill for protection of a cathode with impressed currents, made up by a flexible anodic conductor (1), surrounded by backfill and coaxially centered as to the flexible external casing (2) by means of spacers (3), which function also as current distributors to the casing itself, and supporting the anodic elements (4). The flexible casing (2) and elements (3) are constituted by metallic materials corrodable by the current.

8 Claims, 2 Drawing Figures

Figure 1:
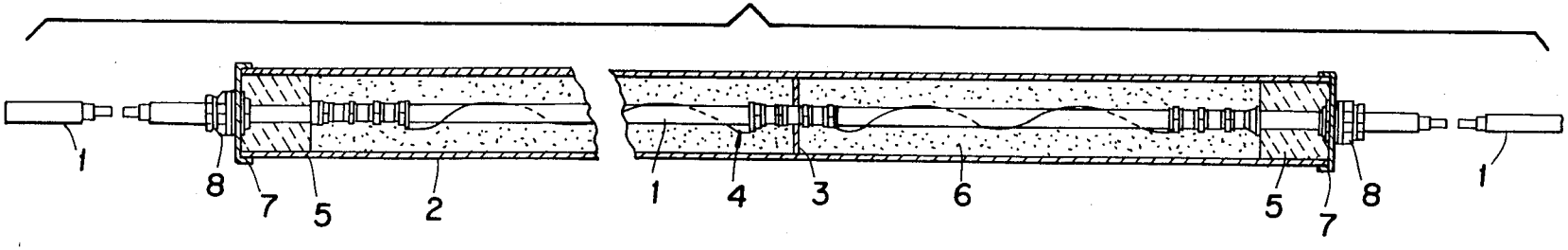

GROUND ANODE PREPACKED WITH BACKFILL IN A FLEXIBLE STRUCTURE FOR CATHODE PROTECTION WITH IMPRESSED CURRENTS

This invention relates to a ground anode prepacked with backfill in a flexible structure for cathode protection with impressed currents, comprising an anodic conductor held by means of special spacers in a substantially coaxial way inside a flexible casing made of corrodable metallic material filled with a conductive carbon backfill in loose form. The anode of this invention is therefore particularly useful for the electro-chemical protection of pipe-lines such as oil pipelines and gas pipelines, drilling platforms and, in general, any other type of metallic structure located in special natural environments.

The known types of ground anodes (see for example U.S. Pat. No. 4,279,729, the applications for U.S. Pat. No. 452,268, now U.S. Pat. No. 4,452,683 and 511.399 of the applicant, and J. A. Jacobis in Material Performances, 1981, PP. 17, 23) are usually installed according to the deep well technique or the horizontal groundbed technique. The first technique calls for a hole in the soil near the structures to be protected, of the appropriate depth (usually 50 to 150 meters) and a diameter of ten or more centimeters. One proceeds then to lower the anodic chain in the above mentioned hole and to pump in backfill mixed with water from the bottom of the hole. Once filled, the hole is closed, still leaving a means for the anodic gas to escape.

The problems connected with the deep well technique come from the difficulty of pumping the backfill, which must be used in an extremely subdivided form and, therefore, does not generally favor the easy elimination of gases together with the necessity to free the hole of drilling mud before pumping. It is necessary, moreover, to evaluate the level of backfill by either calculating the volume pumped, or through resistance measurements on the anodes of the chain. Lastly, in the frequent case of well casing recovery, the compactness of the backfill is negatively influenced or disturbed.

In surface embedding, it is necessary to have a trench which is first initially filled with backfill; after the installation of the anodes which are spaced from one another together with completion of the electric connections between the various anodes and linking cable to the rectifier, the trench is filled with a second amount of backfill which may be compacted.

In surface installation sizeable quantities of backfill must be used which are not strictly necessary for a low ground resistance. Surface installation is made more difficult by the square, rather than circular, cross section of the trench, by the difficulties of achieving a good compactness of the backfill and by the possibility of bed discontinuity because of trench covering.

Both techniques, therefore, suffer from obvious practical and operative difficulties which have been sought to be remedied by prepacked anodes in special containers or rigid cartridges (see U.S. Pat. Nos. 4,400,259, 3,725,699 and "Design and construction of replaceable deep anode groundbeds" by, J. F. Tatum, 8th. Int. Congr. Metallic Corrosion (8th ICMC), Mainz, W. Germany, Sept. 1981).

The use of such prepacked electrodes overcomes specific problems relating to the backfilling of the well and trench, but leaves unsolved convenience of use problems including installation. Also, a rigid structure of significant length in meters involves severe problems in transport and site installation.

The aim of the present invention, as defined in the claim, is to overcome the above mentioned problems.

The anodic structure, which is the subject matter of the present application, is such that it retains or keeps captive the external geometrical characteristics and the compactness of the backfill until the cathode protection plant is started.

Once current begins to flow the spacers hold the anodic conductor coaxially to the flexible and corrodable casing and at the same time, contribute to the distribution of current on the external flexible metallic casing. Once the external casing is corroded to exhaustion the anode will be homogeneously surrounded by backfill and will provide an ideal output. Another advantage of this anode system is that of eliminating pumping and covering, a procedure which is often time consuming and inconvenient. This system on the contrary, offers an easy and quick installation means thanks to the flexibility of the structure, a characteristic which is particularly adaptable for transport. The correct backfill compaction during installation is obtained by means of an elastic continued pressure generated by elements (screen, bands, etc.) of a suitable material positioned at intervals and at the ends of the anodic assembly. Thus an excessive crumbling of the particles of backfill is avoided during the above mentioned stages.

The following illustrates in greater detail the invention referring to the illustrations which represent an example of execution.

Figure 2:
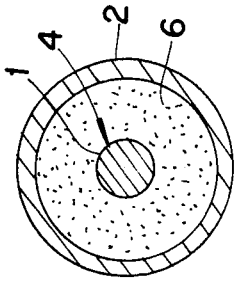

FIG. 1 is a longitudinal view of the anode subject matter of the present invention, while FIG. 2 is a cross section view. Reference 1 indicates the flexible anodic conductor, as a non limiting example produced in accordance with the U.S. patent application No. 511,399, centered coaxially as to the external casing 2 by the spacer 3. The latter may have the form of a perforated disk to allow filling with coke, and is sufficiently elastic to facilitate electric contact between the central anode and the external casing through the backfill.

The reference numeral 4 indicate the anodic elements in the form of cable and wire between segments of tubes. Element 5 represents a screen of appropriate material capable of providing an elastic thrust to the backfill 6. The end piece 7 is composed of the appropriate plastic material (polypropylene, PVC, reinforced polyester) and both ends are fitted with a cable clamp 8 which blocks the cable.

The anodic conductor 1 consists of an electric cable with a rubber-covered copper core to which the anodic elements 4 are connected, which may be in the form of wire, tube, extruded cable, rod, etc. The spacing between the various elements and the length of these guarantee the flexibility of the conductor 1. The anodic materials which can be conveniently used include natural graphite or graphite treated with organic substances, iron silicon alloys or iron silicon chromium alloys platinum plated titanium, niobium or tantalium, with or without a copper conducting core, possibly activated by means of metal oxide conductors and/or ceramic coverings.

The flexible external casing 2 and the spacers 3 are, instead, made of an electro-corrodable metallic material, for example galvanized iron, iron, aluminum, copper or alloys of these. The casing 2 is flexible, mechanically resistant and extensible.

The backfill is, lastly, appropriately composed of graphite, metallurgical coke or calcined petroleum coke, in loose form or fixed with no more than 10% of organic glue or a fluidizing agent.

The backfill, the particles of which will preferably have a diameter no greater than 10 mm, is compacted by vibration inside the casing 2 and therefore subjected to an elastic thrust by means of element 5. The dimensions of the anodic structure of the invention, in themselves not critical, will normally be between 1 and 10 meters in length and from 10 to 500 mm in diameter, preferably from 100 to 300 mm. Various units can be joined together in series to achieve the desired total length, up to 100 meters for example. The current produced, as will be obvious to an expert in the field, will be a function of the type of backfill, its compaction, etc. and will normally be between 0.15 $A/_m$ and 8 $A/_m$, though this range would not be considered as a limit. It is moreover obvious that many changes (of form, materials, dimensions, etc.) can be made to the anodic structure subject matter of this invention, without deviating from the inventive concept of this invention.

We claim:

1. A ground anode prepacked with backfill for cathodic protection against impressed currents comprising:

(a) a corrodable and flexible entirely metallic external casing;

(b) a flexible conductor coaxially centered as to said external casing;

(c) one or more anodic elements surrounding said flexible conductor, said one or more anodic elements being of such length and spaced at such intervals along said cable so as to maintain said conductor and anodic elements in a flexible condition;

(d) one or more spacers connected at lengthwise intervals between the flexible external casing and said anodic elements, said spacers functioning to hold said anodic elements coaxial relative to said external casing;

(e) prepacked backfill compacted within said external casing and surrounding said anodic elements and flexible conductor; and (f) sealing elements at each end of the casing.

2. The ground anode as defined in claim 1, further comprising one or more elastomeric screens at intervals along said flexible external casing to compress said backfill.

3. A ground anode according to claim 1, wherein said external casing is made from corrodable materials from the group consisting of iron, galvanized iron, aluminum, copper, and alloys thereof.

4. A ground anode according to claim 1, wherein the backfill is composed of materials from the group consisting of graphite, metallurgical coke, calcined petroleum coke and mixtures thereof, in loose form or held together with no more than 10% of organic glue or a fluiding agent, with particle diameter less than, or equal to, 10 mm.

5. A ground anode according to claim 1 wherein the anodic elements are composed of materials from the group consisting of natural graphite or graphite treated with organic substances, iron and silicon or iron and silicon and chromium alloys or platinum plated titanium, niobium or tantalum with or without a copper conducting core.

6. A ground anode according to claim 1, wherein the length of the anode is between 1 and 10 meters and a diameter of between 10 and 500 mm.

7. A ground anode according to claim 1, wherein several units are joined together in series to achieve the total length desired up to 100 meters.

8. A cathode protection process for metallic structures subject to electrochemical corrosion comprising:

(a) connecting the metallic structure to the negative pole of an electric current source;

(b) constructing an anodic structure by coaxially centering one or more flexible anodic elements surrounding a flexible conductor within a corrodable flexible entirely metallic external casing by using one or more spacers between said one or more flexible anodic elements and said flexible entirely metallic casing;

(c) packing said anodic structure with backfill between said external casing and said one or more flexible anodic elements;

(d) sealing said anodic structure; and (e) connecting said anodic structure to the positive pole of said electric current source.

* * * * *

UNITED STATES PATENT AND TRADEMARK OFFICE

CERTIFICATE OF CORRECTION

PATENT NO. : 4,544,464

DATED : October 1, 1985

INVENTOR(S) : Bianchi et al

It is certified that error appears in the above-identified patent and that said Letters Patent are hereby corrected as shown below:

Column 3, line 25

In Claim 1, line 2 - delete "against" and substitute therefor --with--

Signed and Sealed this

*Fifth* Day of *August 1986*

[SEAL]

*Attest:*

DONALD J. QUIGG

*Attesting Officer*

*Commissioner of Patents and Trademarks*